United States Patent [19]

Genbauffe

[11] Patent Number: 4,813,596

[45] Date of Patent: Mar. 21, 1989

[54] FUEL CONTROL DEVICE, FUEL CONTROL SYSTEM USING THE DEVICE AND METHOD OF MAKING THE DEVICE

[75] Inventor: Francis S. Genbauffe, Irwin, Pa.

[73] Assignee: Robertshaw Controls Company, Richmond, Va.

[21] Appl. No.: 192,337

[22] Filed: May 10, 1988

[51] Int. Cl.[4] ..... F23Q 9/08

[52] U.S. Cl. ..... 236/15 A; 431/42

[58] Field of Search ..... 236/68 D, 15 A; 431/42

[56] References Cited

U.S. PATENT DOCUMENTS

| | | | |
|---|---|---|---|
| 3,167,250 | 1/1965 | Wantz et al. | 236/68 |
| 3,989,064 | 11/1976 | Branson et al. | 137/614.11 |
| 4,765,536 | 8/1988 | Bergquist | 236/15 A |

OTHER PUBLICATIONS

Prior known fuel control device having an annular heater pilot valve seat.

*Primary Examiner*—William E. Wayner

*Attorney, Agent, or Firm*—Candor, Candor & Tassone

[57] ABSTRACT

A fuel control device, system using the device and method of making the same are provided, the device comprising a housing having an inlet for being interconnected with a fuel source and an outlet for being interconnected to a main burner, the housing having a main valve seat between the inlet and the outlet and a thermostatically operated valve member for opening and closing the main valve seat, the housing having an annular heater pilot valve seat surrounding the main valve seat and being opened and closed by the thermostatically operated valve member at the same time that the thermostatically operated valve member is opening and closing the main valve seat, the housing having an annular auxiliary fuel supply valve seat surrounding the heater pilot valve seat and being adapted to be opened and closed by the thermostatically operated valve member at the same time that the thermostatically operated valve member is opening and closing the main valve seat and the heater pilot valve seat, the housing having a passage for interconnecting the inlet to the auxiliary fuel supply valve seat independently of the main valve seat.

20 Claims, 12 Drawing Sheets

OFF

ON-BAKE

ON-BAKE

ON-BROIL

FUEL CONTROL DEVICE, FUEL CONTROL SYSTEM USING THE DEVICE AND METHOD OF MAKING THE DEVICE

BACKGROUND OF THE INVENTION

1. Field of the Invention

This invention relates to a new fuel control device, such as for supplying gaseous fuel to a burner means of a cooking apparatus, and to a new fuel control system utilizing such a fuel control device as well as to a new method of making such a fuel control device.

2. Prior Art Statement

It is known to provide a fuel control device comprising a housing means having an inlet for being interconnected with a fuel source and an outlet for being interconnected to a main burner means, the housing means having a main valve seat between the inlet and the outlet and a thermostatically operated valve member for opening and closing the main valve seat, the housing means having an annular heater pilot valve seat surrounding the main valve seat and being opened and closed by the thermostatically operated valve member at the same time that the thermostatically operated valve member is opening and closing the main valve seat.

The flow through the heater pilot valve seat of such prior known control device is directed to a main burner pilot which governs main burner flow through the opening and closing of a safety valve. The mechanism of control is the heating of the hydraulic element of the safety valve by the pilot flame. The safety valve is actuated by the hydraulic element to open and permit main burner fluid flow in response to the pilot flow condition.

Also, see the Wantz et al. U.S. Pat. No. 3,167,250 and the Branson et al U.S. Pat. No. 3,989,064 for other fuel control devices having heater pilot valve seat means.

SUMMARY OF THE INVENTION

It is one feature of this invention to provide a new fuel control device for supplying fuel to a burner means and wherein a tendency to starve the heater pilot means of fuel at the time the safety valve means of the fuel control system opens is substantially eliminated.

In particular, it was found according to the teachings of this invention that when the thermostatically operated valve member of a fuel control device opens so as to permit fuel to flow to a heater pilot means, the subsequent opening of the safety valve seat and flow of fuel to the main burner causes a reduction in flow through the heater pilot seat. The pilot flame thus reduced becomes inadequate to keep the safety valve open and closure results. When closure occurs, flow to the heater pilot returns to the former level. The increased pilot flame opens the safety valve which again decreases the flow of fuel to the heater pilot. It can be seen that this condition of instability prevents proper operation of the main burner means.

However, it was found according to the teachings of this invention that an annular auxiliary fuel supply valve seat could be provided in the housing means of the fuel control device so as to surround the heater pilot valve seat and be supplied fuel from the inlet independently of the main valve seat so as to substantially prevent a reduction in the flow of fuel to the heater pilot means during the time the safety valve initially opens so that the heater pilot maintains its heater flame in an operative condition thereof.

For example, one embodiment of this invention provides a fuel control device comprising a housing means having an inlet for being interconnected with a fuel source and an outlet for being interconnected to a main burner means, the housing means having a main valve seat between the inlet and the outlet and a thermostatically operated valve member for opening and closing the main valve seat, the housing means having an annular heater pilot valve seat surrounding the main valve seat and being opened and closed by the thermostatically operated valve member at the same time that the thermostatically operated valve member is opening and closing the main valve seat, the housing means having an annular auxiliary fuel supply valve seat surrounding the heater pilot valve seat and being adapted to be opened and closed by the thermostatically operated valve member at the same time that the thermostatically operated valve member is opening and closing the main valve seat and the heater pilot valve seat, the housing means having passage means for interconnecting the inlet to the auxiliary fuel supply valve seat independently of the main valve seat.

Accordingly, it is an object of this invention to provide a new fuel control device having one or more of the novel features of this invention as set forth above or hereinafter shown or described.

Another object of this invention is to provide a new fuel control system utilizing such a fuel control device, the system of this invention having one or more of the novel features of this invention as set forth above or hereinafter shown or described.

Another object of this invention is to provide a new method for making such a fuel control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
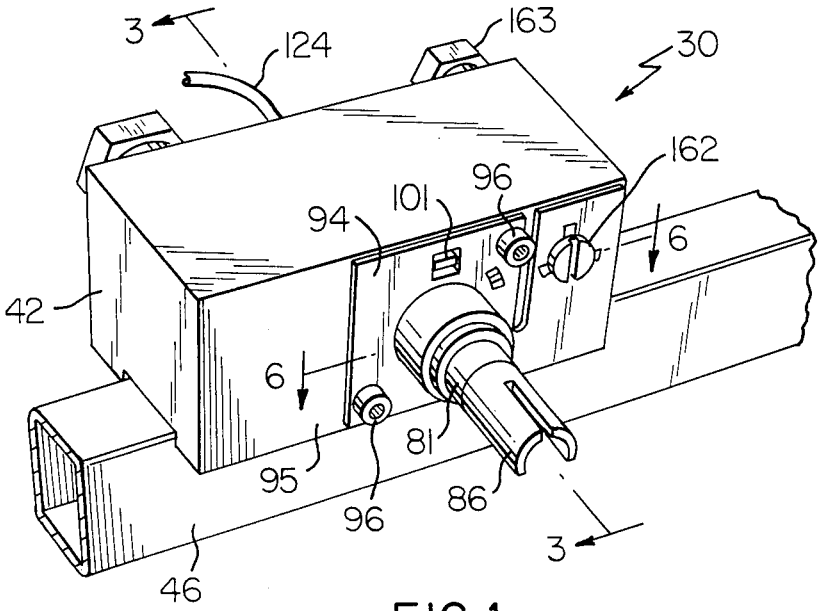
FIG. 1 is a fragmentary perspective view of the front of the new fuel control device of this invention mounted to a fuel supplying manifold means.

While the various features of this invention are hereinafter illustrated and described as being particularly adapted to provide a fuel control device for supplying gaseous fuel to a burner means of a cooking apparatus, such as from a source of propane or a source of natural gas, it is to be understood that the various features of this invention can be utilized singly or in various combinations thereof to provide a fuel control device for supplying other types of fuel and/or to other types of apparatus as desired.

Therefore, this invention is not to be limited to only the embodiment illustrated in the drawings, because the drawings are merely utilized to illustrate one of the wide variety of uses of this invention.

Figure 2:
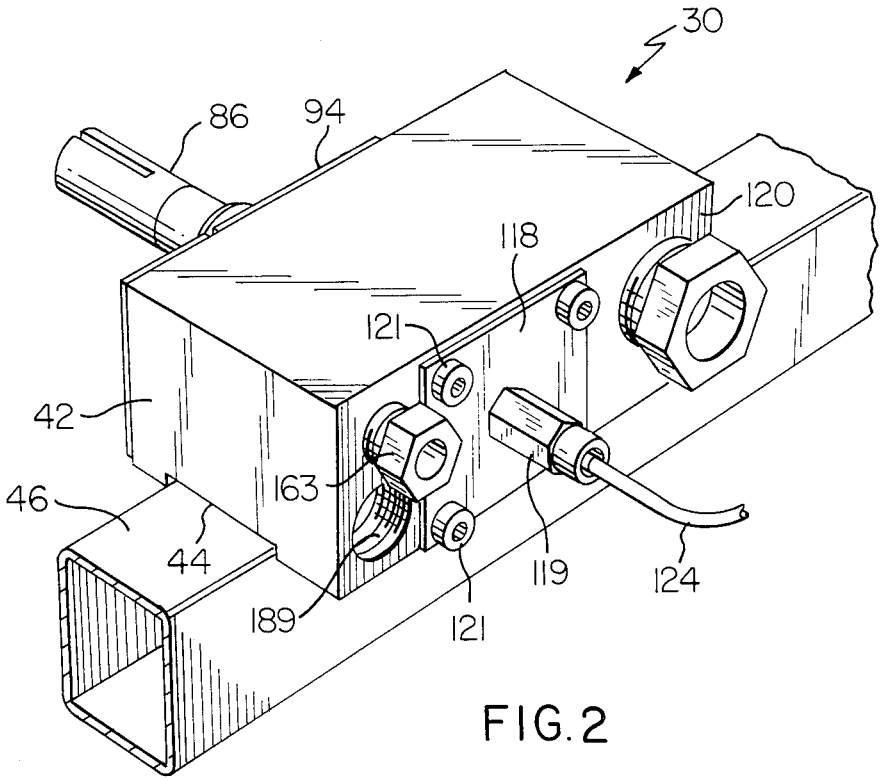
FIG. 2 is a fragmentary perspective view of the rear of the fuel control device of FIG. 1 mounted to the fuel supplying manifold means.
Figure 3:
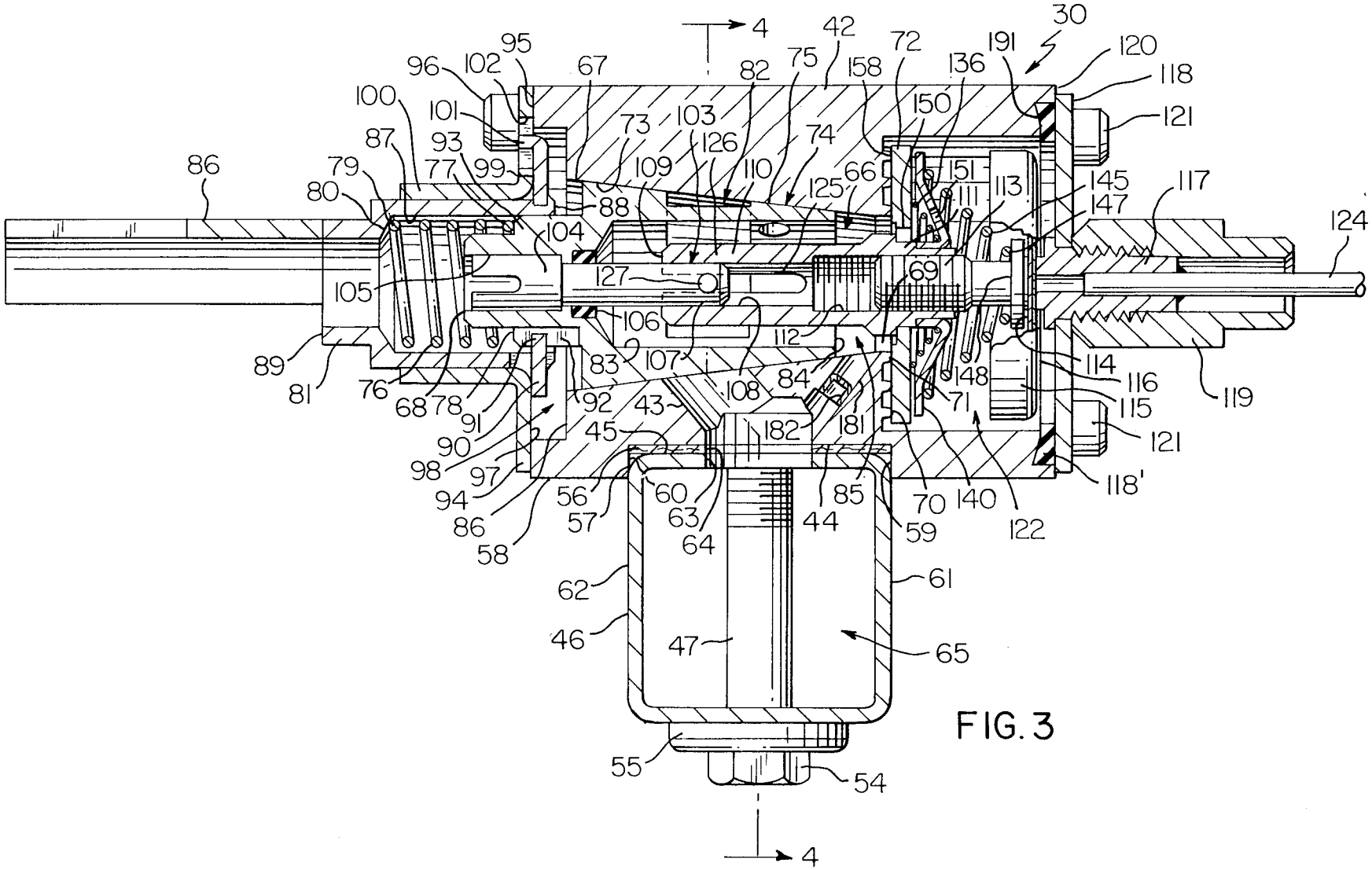
FIG. 3 is an enlarged cross-sectional view taken on line 3—3 of FIG. 1 and illustrates the fuel control device set in its "off" position.
Figure 14:
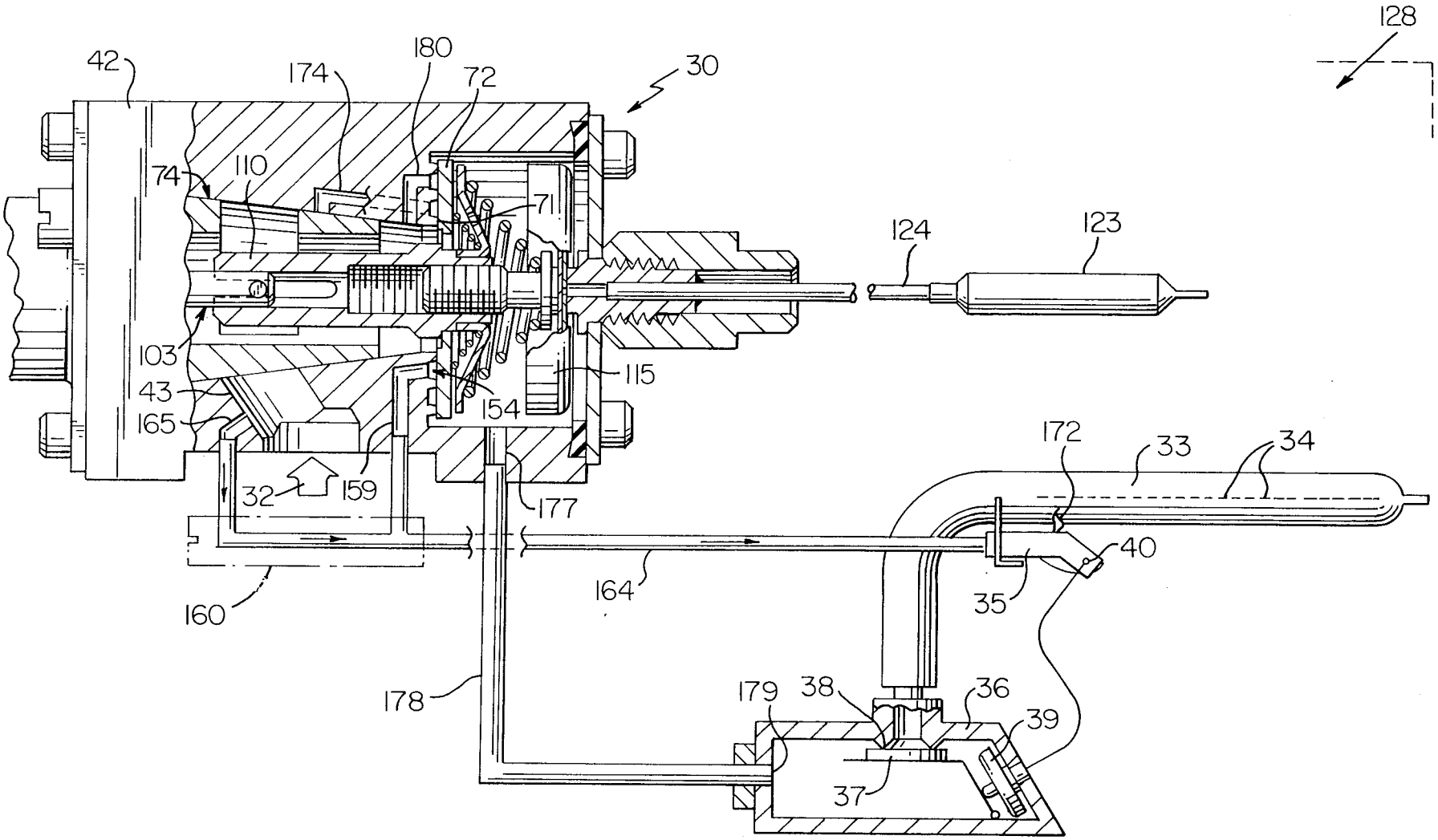
FIG. 14 is a schematic view, partially in cross-section, illustrating the fuel control system of this invention utilizing the fuel control device of FIGS. 1–13, FIG. 14 illustrating the fuel control device set in the "off" position thereof.
Figure 15:
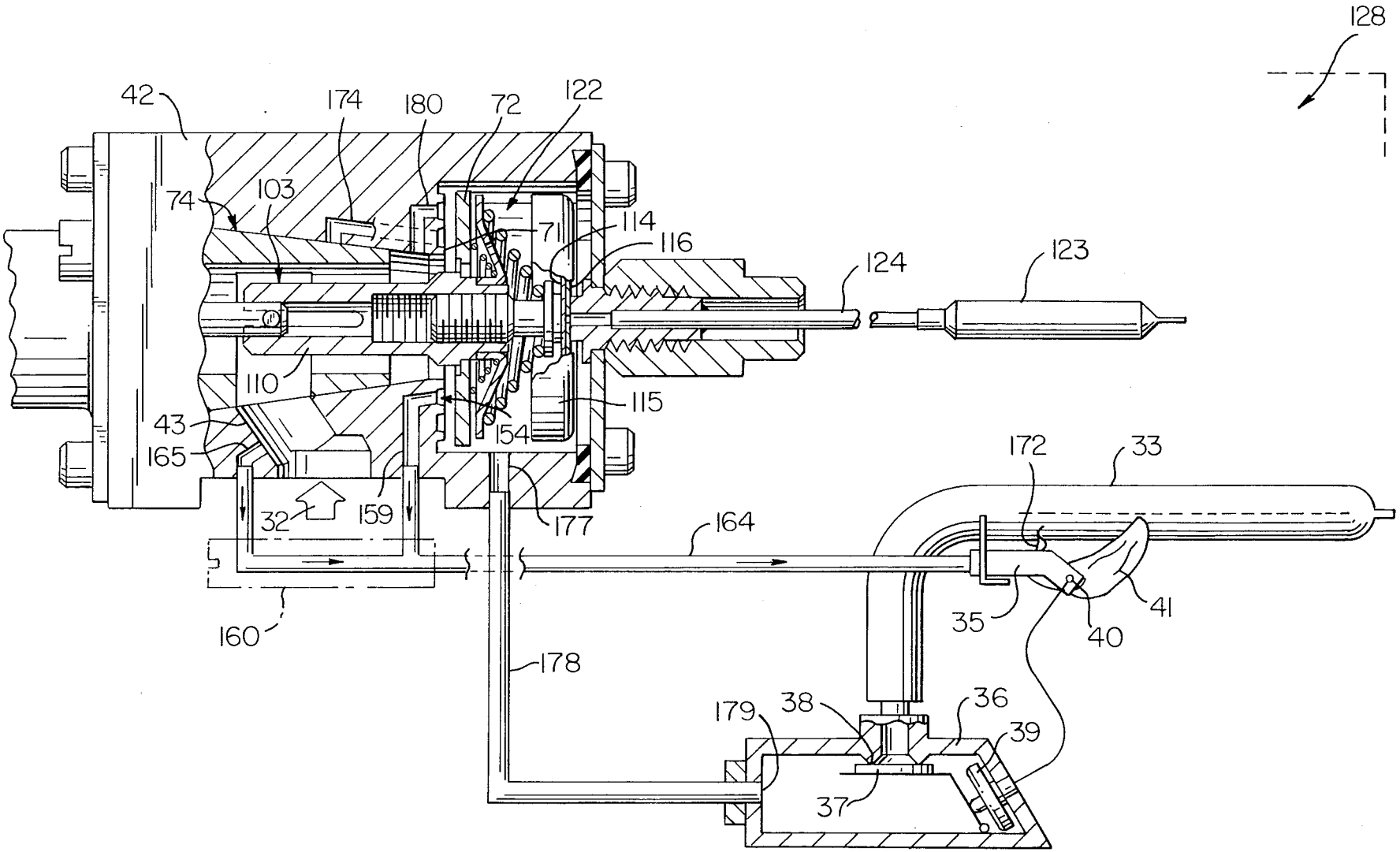
FIG. 15 is a view similar to FIG. 14 and illustrates the fuel control device set in one of its bake "on" conditions and before the safety valve has been opened by the heater pilot means thereof.

Referring now to FIGS. 1–3, the new fuel control device of this invention is generally indicated by the reference numeral 30 and is schematically illustrated in FIG. 14 as being utilized in a new fuel control system of this invention that is generally indicated by the reference numeral 31 and comprises a source of fuel 32, such as gaseous fuel, a main burner means 33 having a plurality of outlet ports 34 for issuing fuel therefrom, a pilot burner means 35 and a safety valve means 36 that is adapted to direct fuel from the fuel control device 30 of this invention to the burner means 33 when a valve member 37 of the valve means 36 is moved away from a valve seat 38 by an actuator means 39 that is controlled by a temperature sensing bulb 40 that detects the presence or absence of a large heater flame 41, FIG. 15, at the pilot burner means 35 in a manner hereinafter set forth and as is well known in the art. For example, see the aforementioned Wantz et al U.S. Pat. No. 3,167,250, and the aforementioned Branson et al U.S. Pat. No. 3,989,064, whereby these two patents are being incorporated into this disclosure by this reference thereto.

Therefore, since the general operation of the parts of the system 31 are well known in the art, a further discussion thereof is deemed unnecessary except that certain features thereof will be hereinafter set forth in order to more fully understand the features of this invention.

Figure 4:
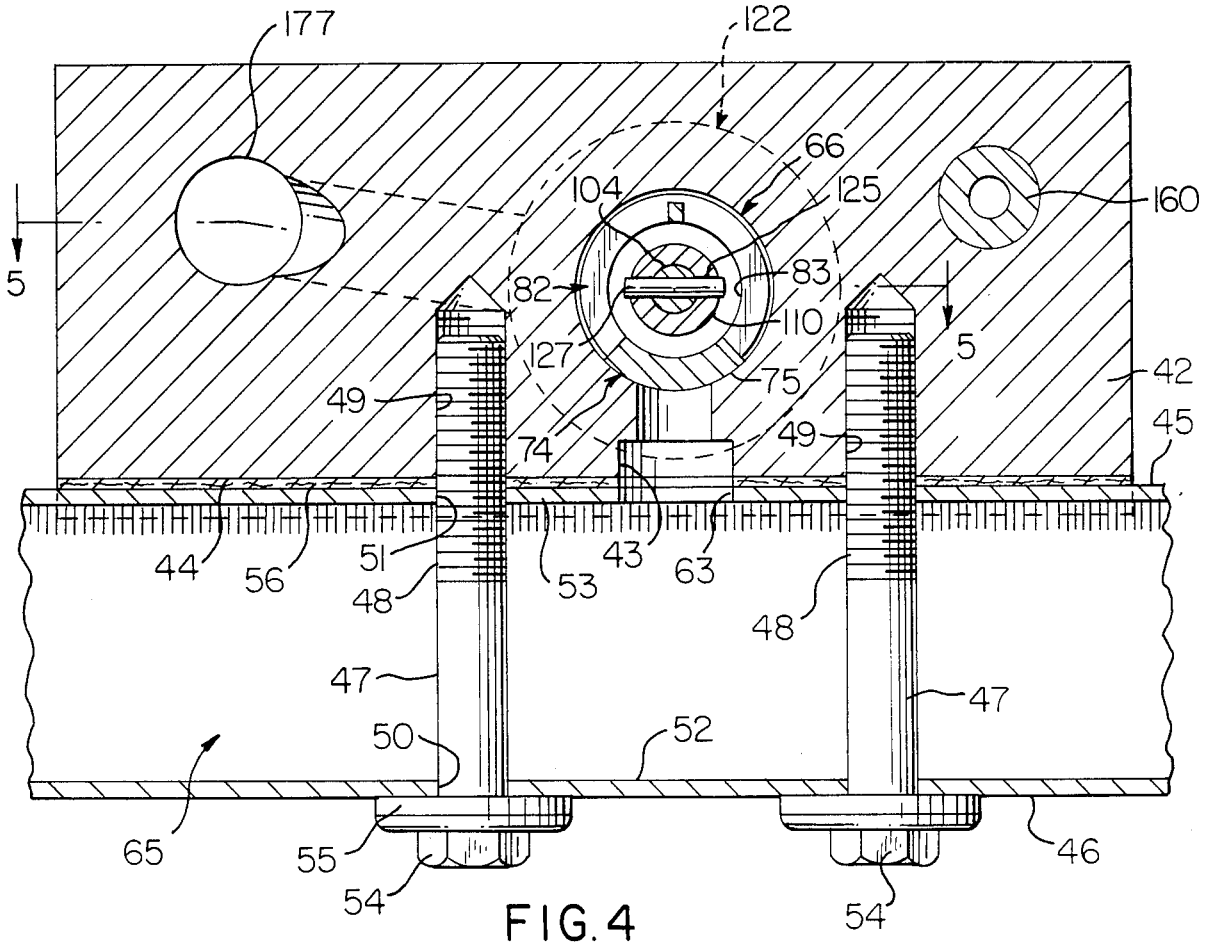
FIG. 4 is a fragmentary cross-sectional view taken on line 4—4 of FIG. 3.
Figure 5:
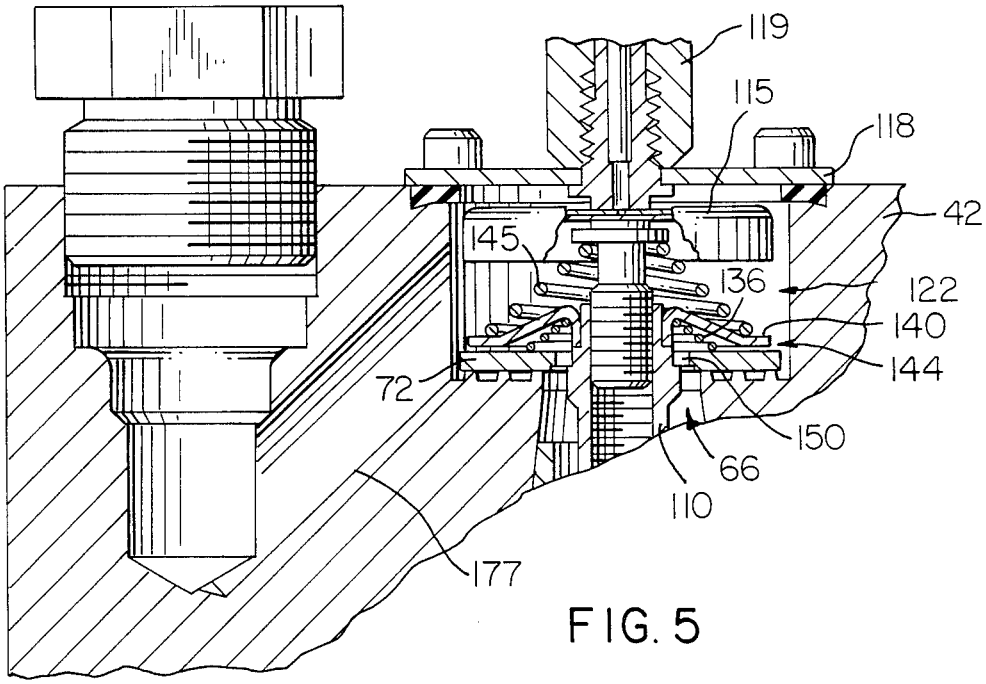
FIG. 5 is a fragmentary cross-sectional view taken on line 5—5 of FIG. 4.

The fuel control device 30 of this invention comprises a housing means 42 that has an inlet passage 43 interrupting a lower surface 44 thereof that is adapted to be sealingly disposed against a top surface 45 of a fuel supplying manifold 46 and be secured thereto by a plurality of threaded fastening members 47 having the threaded shanks 48 thereof threadedly disposed in internally threaded openings 49 formed in the housing means 42 as illustrated in FIGS. 3 and 4, the fastening means 47 passing through aligned openings 50 and 51 respectively formed through a bottom wall 52 and a top wall 53 of the manifold 46 and having the enlarged heads 54 thereof compacting sealing washer means 55 between the heads 54 and the bottom wall 52 of the manifold 46 as illustrated. A sealing gasket means 56 is disposed between the bottom surface 44 of the housing means 42 and the top surface 45 of the top wall 53 of the manifold 46. The bottom wall 44 of the housing means 42 is formed in a recess 57 in the bottom 58 of the housing means 42 and defines a pair of opposed shoulder means 59 and 60 which are adapted to respectively engage against the opposed side-walls 61 and 62 of the manifold means 46 as illustrated in FIG. 3 to firmly secure and align the housing means 42 thereto.

The manifold means 46 has an opening 63 passing through the top wall 53 thereof and is aligned with an opening 64 passing through the sealing gasket 56 so as to be in aligned relation with the inlet 43 of the housing means 42 whereby fuel being supplied from the fuel source 32 into the interior 65 of the manifold 46 is adapted to flow into the inlet 43 of the housing means 42.

However, the inlet passage 43 in the housing means 42 intersects with a substantially frusto-conical passage 66 in the housing means 42 that has the larger end 67 thereof interrupting a substantially flat end wall 86 of the housing means 42 while the smaller end 69 thereof interrupts a substantially flat end wall 70 of the housing means 42 and defines a substantially circular main valve seat 71 therewith that is adapted to be opened and closed by a thermostatically operated valve member 72 in a manner hereinafter set forth.

The frusto-conical passage 66 in the housing means 42 defines a substantially frusto-conical internal peripheral surface 73 of the housing means 42 and has a rotatable plug valve member 74 disposed therein, the plug valve member 74 having a substantially frusto-conical external peripheral surface 75 that is urged into sealing relation with the internal peripheral surface 73 of the housing means 42 by the force of a compression spring 76 having one end 77 bearing against an end surface 78 of the plug valve member 74 and the other end 79 thereof bearing against an internal shoulder 80 of a selector member 81 that is rotatably mounted to the housing means 42 in a manner hereinafter set forth.

In this manner, the plug valve member 74 has the external peripheral surface 75 thereof adapted to completely close off the inlet passage 43 from the housing passage 66 when the plug valve member 74 is disposed in the "off" position as illustrated in FIG. 3 and is adapted to open the inlet passage 43 to the frusto-conical housing passage 66 when a slot means 82 of the plug valve member is rotatably disposed in aligned relation with the inlet 43 so that fuel from the inlet 43 can flow through the slot means 82 and an interconnecting internal passage 83 of the plug valve member 74 to an end 84 thereof and, thus, to a part 85 of the housing passage 66 that is disposed between the end 84 of the plug valve member 74 and the main valve seat 71 so as to supply fuel to the main valve seat 71 for supplying the fuel to the main burner means 33 in a manner hereinafter set forth.

The plug valve member 74 is adapted to be rotated in the housing means 42 by rotation of the selector member 81, the selector member 81 being interconnected to a C-shaped shaft 86 that is adapted to have a selector dial or knob (not shown) secured thereon for rotating the selector member 81, The selector member 81 comprises a hollow tubular member having an opening 87 passing through opposed ends 88 and 89 thereof with the passage 87 being stepped to define the internal shoulder 80 as illustrated. A drive plate 90 is fastened to the end 88 of the selector member 81 and has an inwardly directed drive tang 91 that is received in a slot 92 in a reduced cylindrical portion 93 of the plug valve member 74 that is telescopically disposed within the passage 87 at the end 88 of the selector member 81 whereby rotation of the selector member 81 causes like rotation of the plug valve member 74 through the spline connection of the drive tang 91 and the slot 92 in a manner well known in the art.

The drive plate 90 is disposed between the surface or end wall 86 of the housing means 42 and a cover plate 94 that is secured to an outer extending end surface 95 of the housing means 42 by fastening members 96 whereby the cover plate 94 has a surface 97 thereof that is spaced from the end surface 86 of the housing means 42 to define a chamber 98 therebetween and in which the drive plate 90 is rotatably disposed.

However, a surface 99 of the drive plate 90 is urged into engagement with the surface 97 of the cover plate 94 by the force of the compression spring 76 tending to move the selector member 81 outwardly to the left in FIG. 3 as well as tending to move the plug valve member 74 to the right in FIG. 3, the selector member 81 being rotatably disposed through an outwardly directed tubular portion 100 of the cover plate 94 as illustrated.

An outwardly directed locking tang 101 of the drive plate 90 is normally received in a notch or cutout 102 of the cover plate 94 when the plug valve member 74 is disposed in the "off" position of FIG. 3.

Therefore, in order to rotate the plug valve member 74 to an "on" position thereof wherein the slot 82 of the plug valve member 74 is aligned with the inlet opening 43 in the housing means 42, the operator must push axially inwardly on the selector member 81 to move the same to the right in FIG. 3 until the locking tang 101 clears the opening 102 in the cover plate 94 and thereby permits the plug valve member 74 to then be rotated to its "on" position thereof in a manner well known in the art, the locking tang 101 now bearing against the inside surface 97 of the plate 94 to hold the selector member 81 in its axially in condition until the selector member 81 is subsequently returned to its "off" position wherein the locking tang 101 of the drive plate 90 snaps into its locking engagement with the locking opening 102 under the force of the compression spring 76 in a manner well known in the art.

A shaft means that is generally indicated by the reference numeral 103 is carried by the plug valve member 74 and comprises a first part 104 press-fitted or otherwise secured in a stepped opening 105 through the end 68 of the plug valve member 74 and sealed thereto by sealing means 106, the shaft part 104 having a cylindrical end 107 disposed within an opening 108 formed in an end 109 of another shaft part 110 of the shaft means 103 whereby the shaft part 110 is adapted to axially slide on the shaft part 104 that is normally fixed from movement relative to the plug valve member 74. The shaft part 110 has the opening 108 at the end 111 thereof internally threaded at 112 and threadedly receiving a threaded stud 113 that is fixed to and carried by a movable wall 114 of an expandable and contractible power element 115 that has a fixed wall 116 secured to a stud 117 passing through and being fixed to an end plate 118 by an internally threaded fastening member 119, the end plate 118 being secured to an end 120 of the housing means 42 by fastening means 121 and cooperating therewith to define a chamber 122 between the end surface 70 of the housing means 42 and the end plate 118. The end plate 118 is sealed to the housing means 42 by a suitable sealing means 118' disposed between the end plate 118 and a recess 191 of the housing means 42.

In this manner, the power element 115 is disposed in the chamber 122 of the housing means 42 and the space between the movable wall 114 and the fixed wall 116 of the power element 115 is disposed in fluid communication with a temperature sensing bulb 123, FIG. 15, by a capillary tube means 124 in a manner conventional in the art so that the wall 114 is moved to the left relative to the wall 116 in FIG. 3 as the fluid in the bulb 123 expands through the heating thereof in a manner well known in the art. Such movement of the wall 114 to the left in FIG. 3 carries the threaded stud 113 in unison therewith and, thus, moves the shaft part 110 relative to the fixed shaft part 104, the shaft part 110 having suitable slot means 125 in the end 126 thereof and receiving a transversely disposed spline pin 127 of the fixed shaft part 104 therein which permits axial movement of the shaft part 110 relative to the shaft part 104 but not rotatable movement therebetween as the part 104 is normally fixed to the plug valve member 74. However, rotation of the plug valve member 74 causes the shaft part 104 to rotate in unison therewith and thereby causes the shaft part 110 to likewise rotate therewith and thereby thread onto or be unthreaded from the stud 113 of the power element 115 to various positions on the stud 113 depending on the rotational movement of the plug valve member 74.

In this manner, the fuel control device 42 can be set by an operator to provide a desired temperature within an oven cavity of a cooking apparatus, the oven cavity being generally indicated by the reference numeral 128 in FIG. 14 and is to be heated by the burner means 33 as hereinafter set forth.

Figure 17:
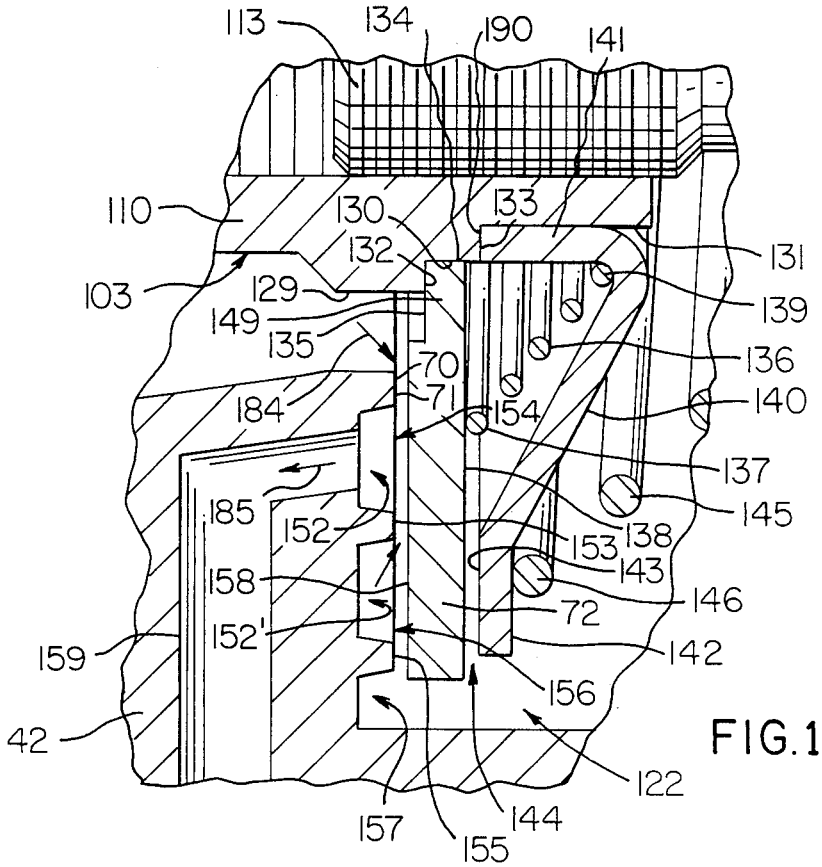
FIG. 17 is an enlarged fragmentary cross-sectional view of a portion of the fuel control device of this invention with the thermostatically operated valve member thereof disposed in an "on" position thereof and before the safety valve of the system of FIG. 16 has opened.

The shaft part 110 of the shaft means 103 of the fuel control device 30, as best illustrated in FIG. 17, has three stepped annular cylindrical surfaces 129, 130 and 131 each having a substantially circular transverse cross-sectional configuration throughout the axial length thereof with the surfaces 129 and 130 cooperating together to define an annular shoulder 132 therebetween and the surfaces 130 and 131 cooperating together to define an annular shoulder 133 therebetween.

The valve member 72 has an opening 134 passing centrally therethrough and being of a size that the surface 130 of the shaft part 110 is adapted to be inserted therethrough so that a surface means 135 of the valve member 72 is adapted to abut against the shoulder 132 in the manner illustrated in FIG. 17 under the force of a compression spring 136 having one end 137 bearing against a side 138 of the valve member 72 and another end 139 bearing against a spring retainer 140 that has a tubular part 141 telescopically disposed on the external peripheral surface 131 of the shaft part 110 and having an end 190 abutting against the shoulder 133 as illustrated. The spring retainer 140 is formed out of metallic material and has an outer annular disc-like part 142 that normally has a flat surface 143 thereof spaced from the side 138 of the valve member 72 so as to provide a passage therebetween that is generally indicated by the reference numeral 144 and being utilized in a manner hereinafter set forth.

A larger compression spring 145 has one end 146 bearing against the disc-like part 142 of the spring retainer 140 and the other end 147 thereof bearing against an annular abutment 148 formed on the stud 113 of the movable wall 114 of the power element 115 so that the force of the compression spring 145 is to tend to maintain the spring retainer 140 against the shoulder 133 of the shaft part 110 as well as to move the disc-like part 142 of the spring retainer 140 toward the valve member 72 when the valve member 72 is against its seat 71 and the power element 115 further expands as will be apparent hereinafter.

Figure 8:
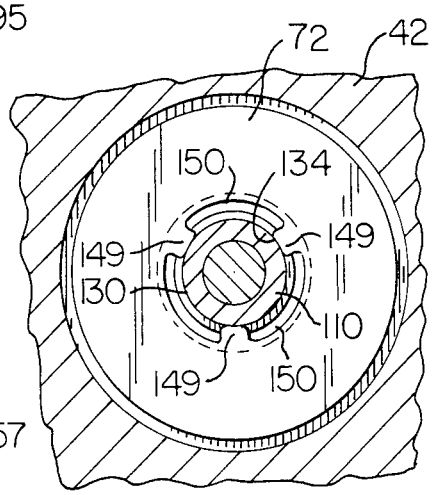
FIG. 8 is a fragmentary cross-sectional view taken on line 8—8 of FIG. 6.
Figure 7:
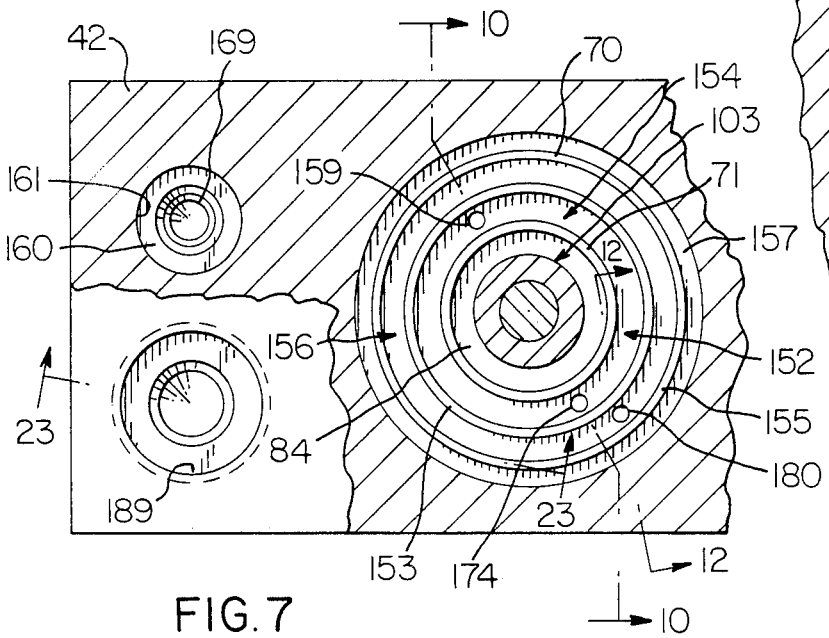
FIG. 7 is a fragmentary cross-sectional view taken on line 7—7 of FIG. 6.
Figure 20:
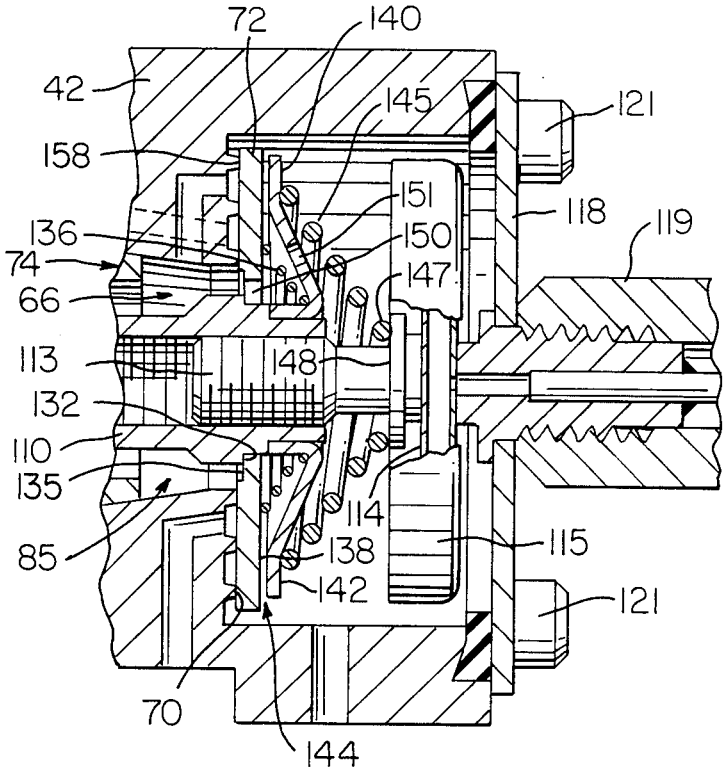
FIG. 20 is an enlarged fragmentary view of a portion of the fuel control device illustrated in FIG. 19 and illustrates the thermostatically operated valve member in one operating position thereof when the control device is set in the "broil" condition thereof.

As illustrated in FIG. 8 the opening 134 through the valve member 72 defines a plurality of inwardly directed tangs 149 that bear in sliding relation against the external peripheral surface 130 of the shaft part 110 so as to define a plurality of spaces or ports 150 that are adapted to always interconnect the part 85 of the passage 66 of the housing means 42 with the chamber 122 of the housing means 42 even when the valve member 72 is disposed against the main valve seat 71 as the openings or ports 150 through the valve member 72 lead to the space between the valve member 74 and the spring retainer 140 so that fuel can flow from the passage 66 to the chamber 122 by way of the space 144 between the valve member 72 and the disc-like part 142 of the spring retainer 140 as well as through a suitable opening 151 formed through the spring retainer 140 as illustrated in FIGS. 3 and 20 for a purpose hereinafter set forth.

Figure 6:
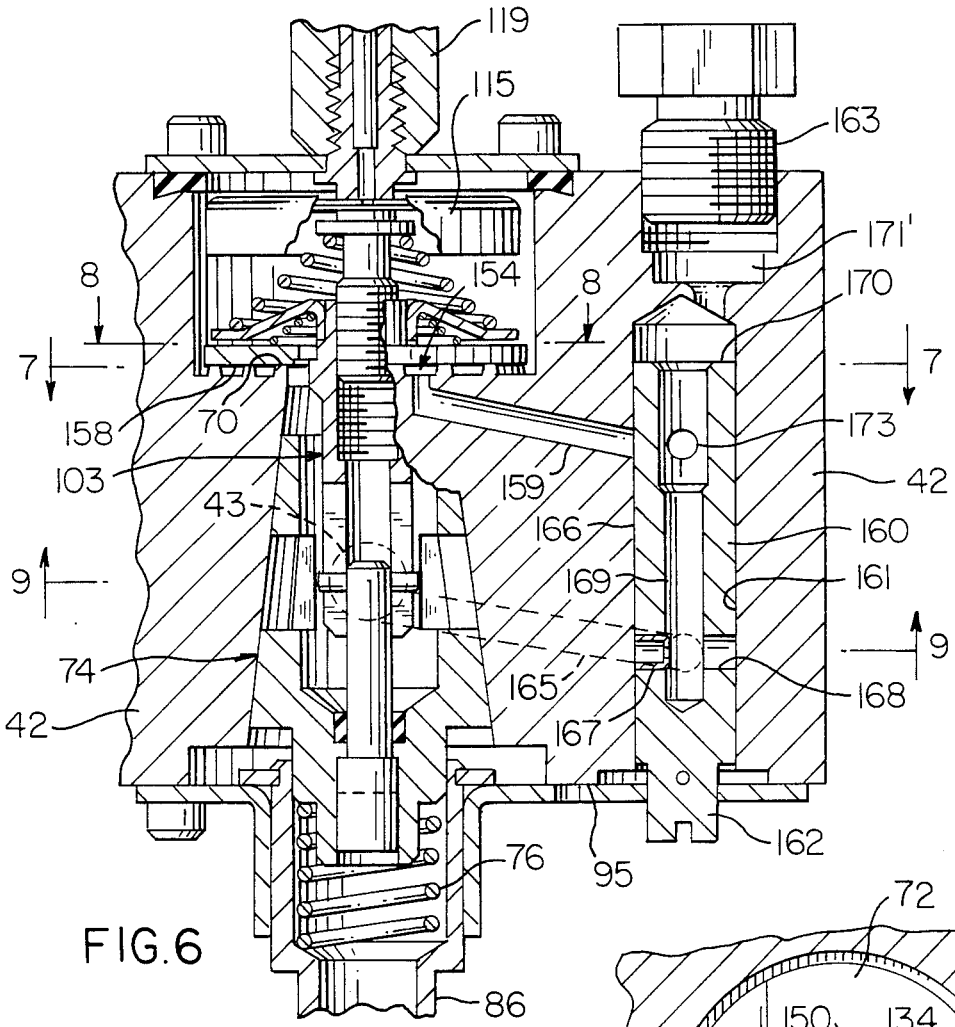
FIG. 6 is an enlarged fragmentary cross-sectional view taken on line 6—6 of FIG. 1.

The surface 70 of the housing means 42 has a first annular recess 152 interrupting the same in a concentric manner about the main valve seat 71 whereby the annular recess 152 defines another flat annular surface 153 that is coplanar with the resulting annular surface 71 of the main valve seat, the cooperating annular flat surfaces 71 and 153 defining an annular heater pilot valve seat means that is generally indicated by the reference numeral 154 and that is adapted to be opened and closed by the valve member 72 at the same time that the valve member 72 is opening and closing the main valve seat 71 as illustrated in FIGS. 3 and 6. Thus, as the valve member 72 moves in an opening direction to the right as illustrated in FIG. 17, the main valve seat 71 and the heater pilot valve seat 154 are opened in unison for a purpose hereinafter set forth.

Another annular recess 152' interrupts the flat surface 70 of the housing means 42 in a concentric manner relative to the main valve seat 71 and to the heater pilot valve seat 154 to define a flat annular surface 155 that cooperates with the flat annular surface 153 to define an annular auxiliary fuel supply valve seat that is generally indicated by the reference numeral 156 in FIG. 17 and that is adapted to be opened and closed by the valve member 72 at the same time that the valve member is opening and closing the main valve seat 71 and the heater pilot valve seat 154 for a purpose hereinafter set forth.

A third annular recess 157 interrupts the flat surface 70 of the housing means 42 in a concentric manner that surrounds the auxiliary fuel supply valve seat 156 so that it can be seen that the surfaces 71, 153 and 155 define annular flat surfaces that are separated by the annular recesses 152 and 152' and are coplanar so as to be simultaneously engaged by the side 158 of the valve member 72 as illustrated in FIGS. 3 and 6 and thereby be closed simultaneously by the valve member 72.

The heater pilot valve seat 154 is disposed in fluid communication with a passage 159 formed in the housing means 42 that leads from the recess 152 to a pilot gas selector key or rotatable member 160 that is rotatably mounted in an opening 161 that is formed in the housing means 42 and interrupts the end surface 95 thereof as illustrated whereby a bifurcated end 162 of the adjusting key 160 can be utilized to adjust the position of the adjusting key 160 so as to provide for either LP gas or natural gas in a manner well known in the art.

Figure 9:
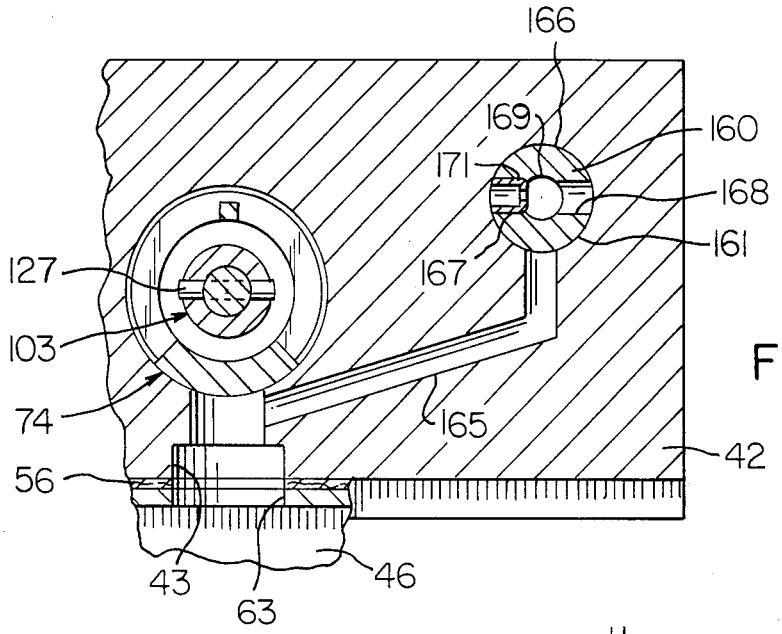
FIG. 9 is a fragmentary cross-sectional view taken on line 9—9 of FIG. 6.

In particular, depending upon the rotational position of the adjusting key 160, the adjusting key 160 is so arranged in the opening or bore 161 of the housing means 42 that the adjusting key 160 will provide a certain amount of gaseous fuel to flow therethrough to an outlet fitting 163 that is adapted to be interconnected to the pilot burner 35 by a conduit means 164 as illustrated in FIG. 14, the bore 161 for the adjusting key 160 being disposed in fluid communication with another passage 165 in the housing means 42 that leads to the inlet passage 43 in advance of the plug valve member 74 as illustrated in FIGS. 6 and 9 so that the plug valve member 74 does not control the pilot gas flow from the passage 165.

The adjusting key 160 has an external peripheral surface 166 that is interrupted by a pair of cross bores 167 and 168 that lead to an internal passage 169 thereof as illustrated in FIG. 9, the internal passage 169 being open to an end 170 thereof and, thus, to a space 171' between the adjusting key 160 and the outlet fitting 163 as illustrated in FIG. 6.

A restricting orifice cup 171 is disposed in the cross bore 167 as illustrated in FIG. 9 so that when the adjusting key 160 is positioned so as to have the cross bore 167 in fluid communication with the passage 165, only a certain amount of gaseous fuel from the inlet 43 is permitted to continuously flow out of the outlet fitting 163 to the pilot burner means 35 as illustrated in FIG. 14 and provide a continuously burning standby flame 172 as illustrated in FIG. 14, the restricting cup 171 being utilized for a high pressure gas source such as propane and the like. Conversely, when natural gas is being utilized, the adjusting key 160 is rotated so that the cross bore 168 is disposed in alignment with the passage 165 so that a certain amount of gaseous fuel will continuously flow to the pilot burner means 35 to produce the standby flame 172 as previously set forth. Of course, when the adjusting key 160 is turned so that neither cross bore 167 or 168 is in alignment with the passage 165, no fuel can flow to the pilot burner 35 from the passage 165.

Whenever the selector key 160 is disposed in an "on" position thereof with either the cross bore 167 or the cross bore 168 disposed in fluid communication with the passage 165, suitable opening means 173 in the selector key 160 interconnect the passage 169 thereof to the passage 159 from the heater pilot valve seat 154 so that a flow of gas into the opened heater pilot valve seat 154 will be added to the standby flow being directed by the selector key 160 to the pilot burner means 35 so as to create the large heater flame 41 previously described and thereby cause the opening of the safety valve means 36 for a purpose hereinafter set forth. However, when the valve member 72 is disposed in its seated position that closes the heater pilot valve seat 154, only the standby flow of fuel is provided by the selector key 160 so that the heater flame 41 ceases to exist and only the standby flame 172 remains at the pilot burner means 35 in a manner well known in the art.

Figure 11:
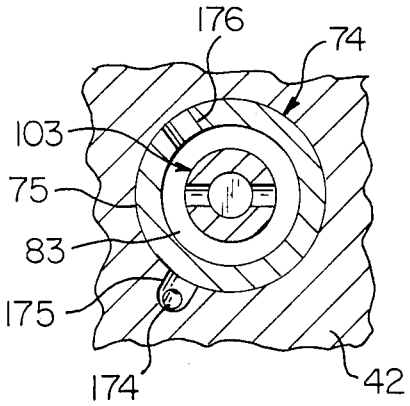
FIG. 11 is a fragmentary cross-sectional view taken on line 11—11 of FIG. 10.
Figure 10:
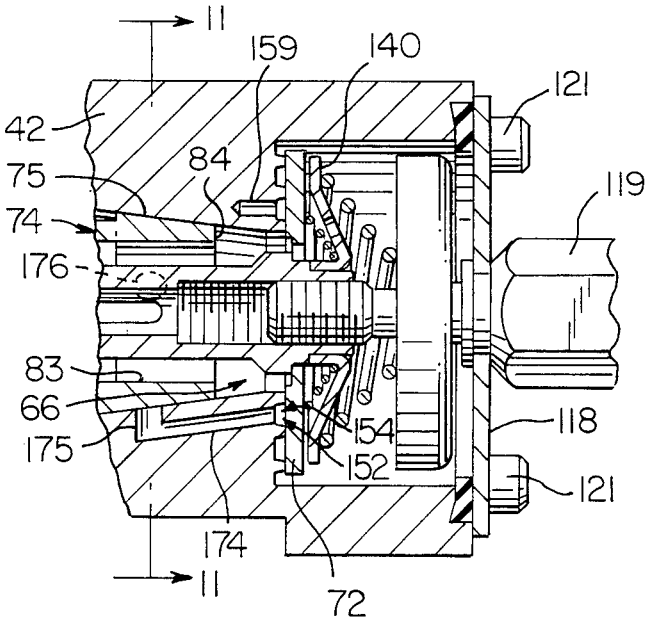
FIG. 10 is a fragmentary cross-sectional view taken on line 10—10 of FIG. 7.
Figure 12:
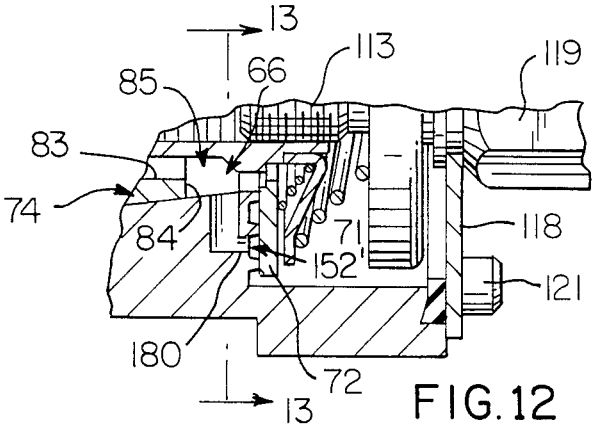
FIG. 12 is a fragmentary cross-sectional view taken on line 12—12 of FIG. 7.
Figure 13:
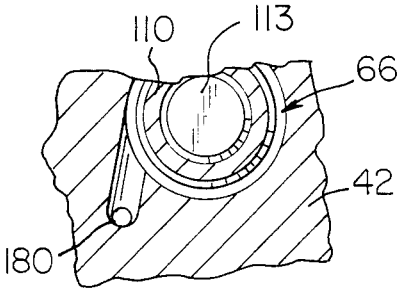
FIG. 13 is a fragmentary cross-sectional view taken on line 13—13 of FIG. 12.

The housing means 42 has a continuous broiling by-pass passage 174 formed therein and leading from the annular heater pilot recess means 152 to the passage 66 at a point where the plug valve member 74 controls the end 175 of the by-pass passage 174 as illustrated in FIGS. 10 and 11.

In particular, the plug valve member 74 has an opening 176 formed therethrough and leading from the external peripheral surface 75 thereof to the passage 83 thereof, the opening 176 aligning with the end 175 of the passage 174 when the selector member 81 is set in a "broil" setting position thereof so that fuel will be continuously supplied to the annular recess 152 even though the valve member 72 may close the heater pilot valve seat 154. Thus, the heater flame 41 at the pilot burner 35 will be continuously formed to maintain the safety valve 36 in an open condition thereof during the entire time the selector member 81 is set in the "broil" position thereof even though the valve member 72 might be in a closed position thereof.

In addition, it can be seen that with the valve member 72 in the closed position and with the selector member 81 disposed in the "broil" position thereof, a by-pass flow of fuel is provided to the main burner 33 as the fuel from the end 85 of the passage 66 can pass through the opening means 150 of the valve member 72 and out through the space 144 between the valve member 72 and the spring retainer 140 as illustrated in FIG. 20 to produce a reduced flow of fuel to the main burner 33 as well as through the opening 151 in the spring retainer 140. Also, should the spring retainer 140 be moved against the valve member 72 in the manner illustrated in FIG. 21 to close the space 144, a still more reduced flow of fuel will be provided to the main burner 33 through the fixed opening 151 in the spring retainer 140 as will be more fully set forth hereinafter.

The chamber 122 of the housing means 42 is interconnected to an outlet port 177, FIG. 4, that is interconnected by a suitable conduit means 178 to the inlet 179 of the safety valve 36.

The auxiliary fuel supply recess 152' of the housing means 42 is interconnected to a passage 180 that leads to the portion 85 of the passage 66 in the housing means 42 that is downstream of the end 84 of the plug valve 74 so that as long as the plug valve member 74 is disposed in an "on" position thereof, fuel is directed into the annular recess 152' even though the valve member 72 may be closing the main valve seat 71, such an auxiliary flow of fuel to the annular recess 152' forming a unique feature of this invention as hereinafter set forth to tend to prevent the fuel starving of the heater pilot flame 41 upon each initial opening of the safety valve means 36 as will be apparent hereinafter.

Therefore, it can be seen that the fuel control system 31 and the fuel control device 30 of this invention can be formed by the method of this invention as previously set forth to operate in a manner now to be described.

Assuming that the selector member 81 of the control device 30 is disposed in the "off" position as illustrated in FIGS. 3 and 14 so that the plug valve member 74 is closing the main inlet passage 43 from the housing passage 66 and that the selector key 160 is set so that the cross bore 168 is in alignment with the passage 165 so that a standby flow of fuel is being provided by the selector key 160 to the pilot burner 35 which has been previously ignited so as to provide the continuously burning standby flame 172, the safety valve 36 is therefore disposed in the "off" position thereof because the flame sensing bulb 40 is in a cooled condition thereof and the actuator 39 maintains the valve member 37 in its closed condition against the valve seat 38 so that no fuel could flow from the fuel control device 30 to the main burner 33. However, fuel is provided into the chamber 122 of the housing means 42 as a passage 181 is formed in the housing means 42 and leads from the inlet passage 43 to the part 85 of the housing passage 66 that is downstream of the end 84 of the plug valve 74. An orifice cup 182 is disposed in the passage 181 so as to limit the amount of fuel from the inlet 43 to the chamber 122 through the openings 150 of the valve member 74 and the spacing 144 and opening 151 previously described whereby such passage 181 and orifice cup 182 could never supply a sufficient amount of fuel therethrough which by itself could support combustion.

Should the operator of the fuel control system 31 desire to operate the system 31 in a baking mode thereof, the operator pushes axially inwardly on the shaft 86 so as to have the locking tang 101 of the drive plate 90 clear the locking opening 102 and permit rotation of the plug valve member 74 from its "off" position to a selected "on" bake temperature setting position thereof, such as 350° F., whereby such rotation of the plug valve member 74 causes the shaft part 110 to thread further onto the threaded stud 113 of the power element 115 so that the valve member 72 is moved away from the valve seat surface 70 in opposition to the force of the compression spring 136. Thus, all of the valve seats 71, 154 and 156 are disposed in an open position as illustrated in FIG. 17 as the temperature being sensed by the temperature sensing bulb 123 for the oven cavity 128 is below a temperature thereof which would cause the power element 115 to close the valve member 72 against the valve seat surface means 70.

Since the valve member 72 is disposed in the open position as illustrated in FIG. 17, it can be seen that fuel is now adapted to pass through the opened main valve seat 71 and flow into the chamber 122 to pass through the outlet 177 to the closed valve member 37 of the safety valve 36 as well as into the opened heater pilot valve seat 154 and flow through the passage 159 and selector key 160 to the pilot burner 34 to increase the amount of fuel thereof and, thereby, create the large heater flame 41 in the manner illustrated in FIG. 15 and in the manner well known in the art.

Figure 16:
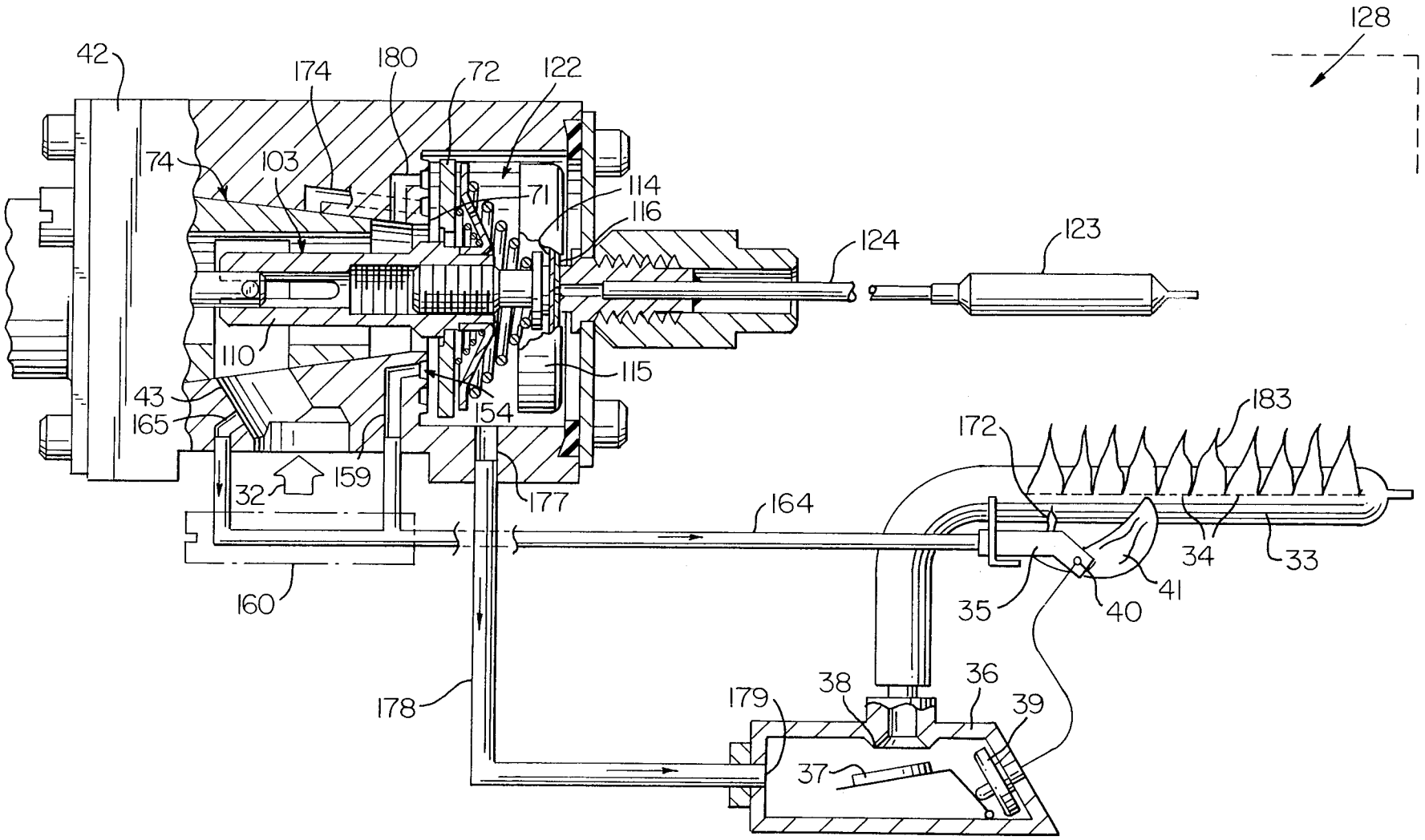
FIG. 16 is a view similar to FIG. 15 and illustrates the fuel control system after the heater pilot means has caused the safety valve means to open.

The large heater flame 41 now heats the temperature or flame sensing bulb 40 of the safety valve 36 so that the power element 39 expands in a manner well known in the art and eventually snaps the valve member 37 from its closed position of FIG. 15 to its open position of FIG. 16 to permit fuel to now flow from the outlet chamber 122 of the housing means 42 to the main burner means 33 and issue out of the ports 34 thereof to be ignited by the standing pilot flame 172 and /or heater flame 41 and thereby create the heating flames 183 at the main burner 33 as illustrated in FIG. 16.

As long as the temperature in the oven cavity 128 is below the temperature setting of the selector member 81, the power element 115 maintains the thermostatically operated valve member 72 in its open position to continuously feed fuel not only to the pilot burner 35 to maintain the heater flame 41, but also to direct fuel to the main burner means 33 through the open safety valve 36.

As the temperature in the oven cavity 128 approaches the selected temperature of the selector member 81, the power element 115 has expanded in such a manner that the movable wall 114 thereof has moved the stud 113 and, thus, the part 110 of the shaft means 103 to the left in FIG. 3 so that the valve member 72 approaches the main valve seat in a manner to throttle down the amount of fuel flow therethrough. However, when the temperature in the oven cavity 128 is substantially at the selected temperature of the selector member 81, the power element 115 forces the valve member 72 against the valve surface 70 to not only close the main valve seat 71, but also to simultaneously close the heater pilot valve seat 154 so that fuel is no longer adapted to flow through the heater pilot passage 159 to the pilot burner means 35 so that the heater flame 41 ceases to exist. Once the heater flame 41 ceases to exist, even though the small standby flame 172 remains at the pilot burner 35, the bulb 40 eventually detects that the heater flame 41 no longer exists so that the same causes the power element 39 of the safety valve 36 to snap close the valve member 37 against the valve seat 38 in a manner well known in the art and thereby terminates any flow of fuel to the main burner means 33 so that the flames 183 cease to exist at the main burner means 33.

Thus, it can be seen that the power element 115 under control of the temperature sensing bulb 123 opens and closes the main valve member 72 so as to operate the main burner means 33 in a cyclical manner to tend to maintain the temperature in the oven cavity 128 at the selected temperature.

As previously set forth, each time the power element 115 initially opens the valve member 72 away from the valve surface 70 to simultaneously open the main valve seat 71 and the heater pilot valve seat 154 in the manner illustrated in FIG. 17, fuel now passing through the opened main valve seat 71 is adapted to enter into the opened heater pilot valve seat 154 as represented by the arrow 184 illustrated in FIG. 17 and be directed into the passage 159 as represented by the arrow 185 in FIG. 17. This flow of fuel into the heater pilot passage 159, as previously set forth, causes the main heater flame 41 to operate the safety valve 36.

However, it was found according to the teachings of this invention that when the safety valve 36 has the valve member 37 thereof snapped open by the power element 39 in the manner previously set forth, a large rush of fuel that has been previously supplied to the safety valve 36 now flows to the main burner means 33 to issue out of the ports 34 thereof so that there is a tendency to rapidly and temporarily evacuate the fuel in the chamber 122 of the housing means 42 of the control device 30 so that the pull of fuel out of the chamber 122 by the rapidly opened safety valve 36 causes a pulling away of the fuel being directed into the heater pilot valve seat 154 so that a starving or a reducing of the flow of fuel to the heater pilot passage 159 initially occurs and tends to reduce the size of the heater flame 41 so that the detector 40 for the power element 39 of the safety valve 36 will close the safety valve 36 at this time and thereby cause a disruption in the desired operation of the main burner means 33.

Figure 18:
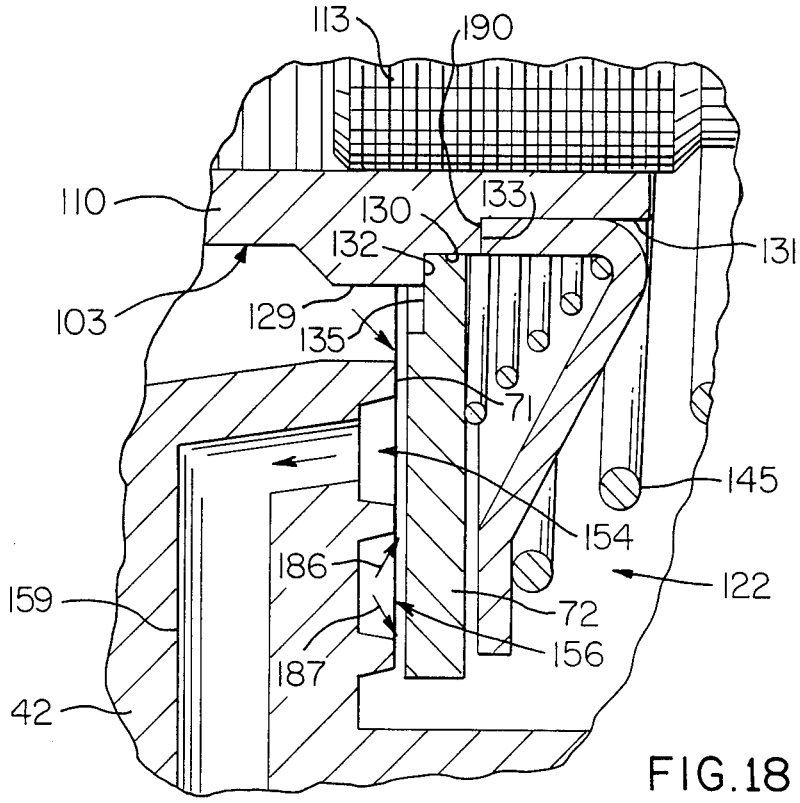
FIG. 18 is a view similar to FIG. 17 and illustrates the fuel control device after the safety valve of the system of FIG. 16 has been initially opened.
Figure 19:
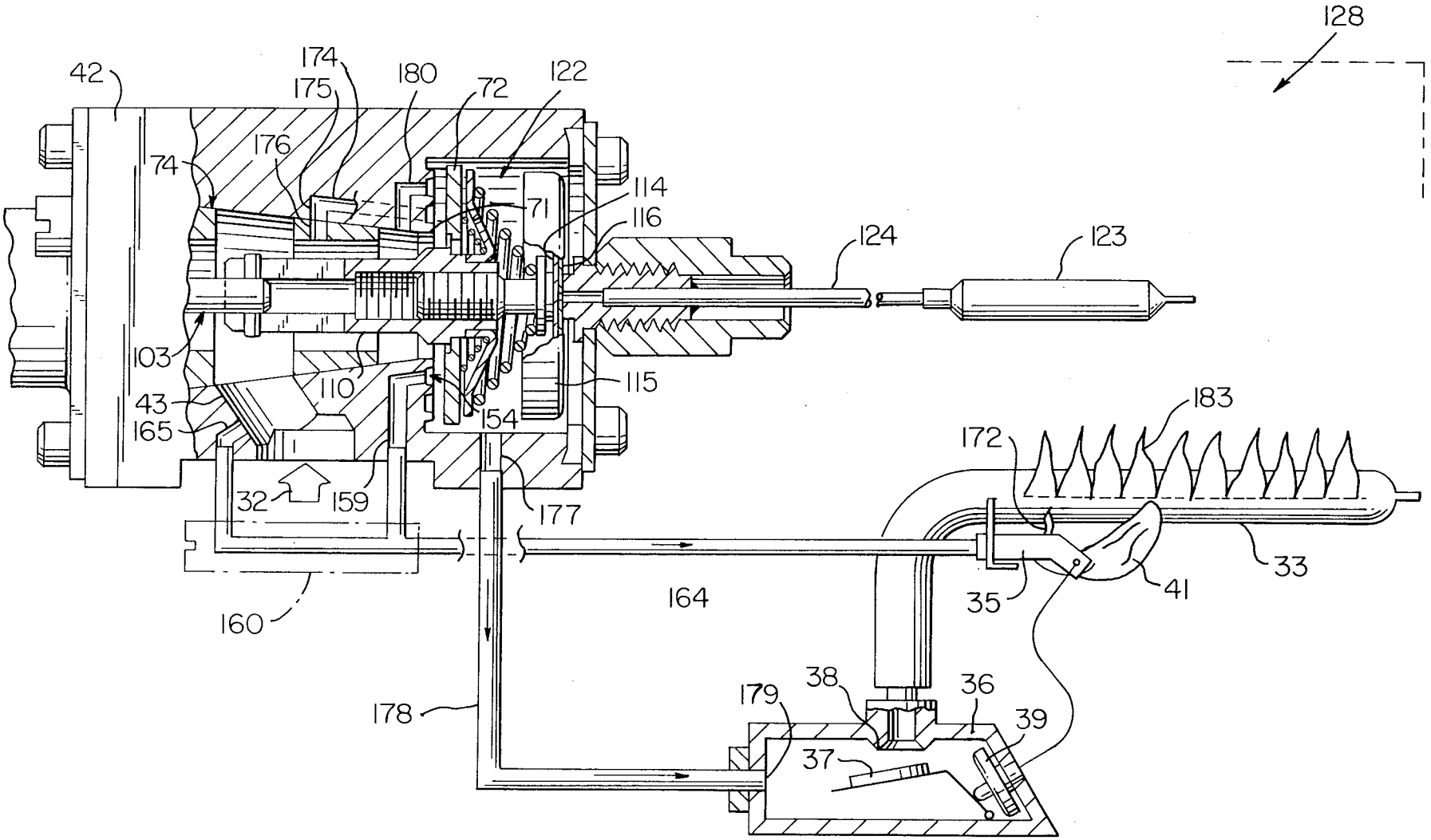
FIG. 19 is a view similar to FIG. 14 and illustrates the fuel control system of this invention when the fuel control device is set in a "broil" condition thereof and after the heater pilot means of the system has opened the safety valve means thereof.

Accordingly, it was found according to the teachings of this invention that by providing the auxiliary fuel supply recess 152' in a surrounding relation around the heater pilot valve seat 154 and having the valve member 72 simultaneously open the auxiliary fuel supply valve seat 156 at the same time that the heater pilot valve seat 154 and the main valve seat 71 are opened by the valve member 72, the auxiliary flow of fuel being provided out of the now opened auxiliary fuel supply valve seat 156 by the passage 180 previously set forth causes fuel to flow out of the auxiliary fuel supply recess 152' in the directions illustrated by the arrows 186 and 187 in the manner illustrated in FIG. 18 so that when the safety valve 36 has the valve member 37 thereof initially snapped to an open position to tend to drain the supply of fuel from the chamber 122 of the housing means 42 of the fuel control device 30 in the manner previously set forth, the flow of fuel as represented by the arrow 186 out of the auxiliary fuel supply recess 152' is directed toward the heater pilot valve seat 154 into the passage 159 to prevent the aforementioned starving of fuel from the open heater pilot valve seat 154. Thus, the heater pilot flame 41 remains of a sufficient size to maintain the detector 40 of the power element 39 of the safety valve 36 in a condition to maintain the valve member 37 in the open position even though the safety valve 36 has just been initially opened.

While the use of the auxiliary fuel supply valve seat 156 in the manner previously set forth is particularly adapted to be utilized when the safety valve 36 is of a snap-opening variety, it is to be understood that the auxiliary fuel supply valve seat 156 can be utilized also with a safety valve that is a slow open and closing type as the function of the auxiliary fuel supply valve seat 156 will be the same and that is to provide a sufficient amount of fuel to the heater pilot valve seat 154 at the time the safety valve initially opens on each opening cycle thereof in the manner previously set forth.

Therefore, it can be seen that the fuel control device 30 of this invention functions in the system 31 of this invention to cycle the main burner means 33 in an "on" and "off" condition to tend to maintain the temperature in the oven cavity 128 at the temperature selected by the selector member 81, such cycling action of the main burner means 33 occurring during the various "bake" settings of the selector member 81.

However, when the selector member 81 is set for a "broil" operation, the plug valve 74 has been so rotated that the same now has the passage 176 thereof aligned with the end 175 of the by-pass passage 174 that leads to the heater pilot recess 152 and, thus, to the heater pilot valve seat 154 even though the valve member 72 might be disposed in a closed condition against the surface 70 by the power element 115 as the bulb 123 might be sensing too high of a temperature in the oven cavity 128. Thus, the heater pilot recess 152 continuously supplies sufficient fuel to the heater pilot passage 159 to continuously maintain a heater flame 41 at the pilot burner 35 during the entire time that the selector member 81 is disposed in a "broil" position thereof.

Thus, with the heater flame 41 always being continuously formed during the "broil" setting of the selector member 81, the safety valve 36 is always in an open condition and should the valve member 72 be moved by the power element 115 against the valve seat surface 70 so as to simultaneously close the main valve seat 71, the heater pilot valve seat 154 and the auxiliary fuel supply valve seat 156 in the manner illustrated in FIG. 20, sufficient fuel, though reduced in amount, is still directed to the chamber 122 of the housing means 42 and, thus, to the main burner 33 to maintain the flames 183 for a broiling operation even though the flames 183 will be in a reduced size thereof because sufficient fuel flows from the housing passage 66 through the openings 150 of the closed valve member 72 and then out through the space 144 between the valve member 74 and spring retainer 140 to the chamber 122 as well as out of the opening 151 of the spring retainer 140 to the chamber 122 as previously set forth.

Figure 21:
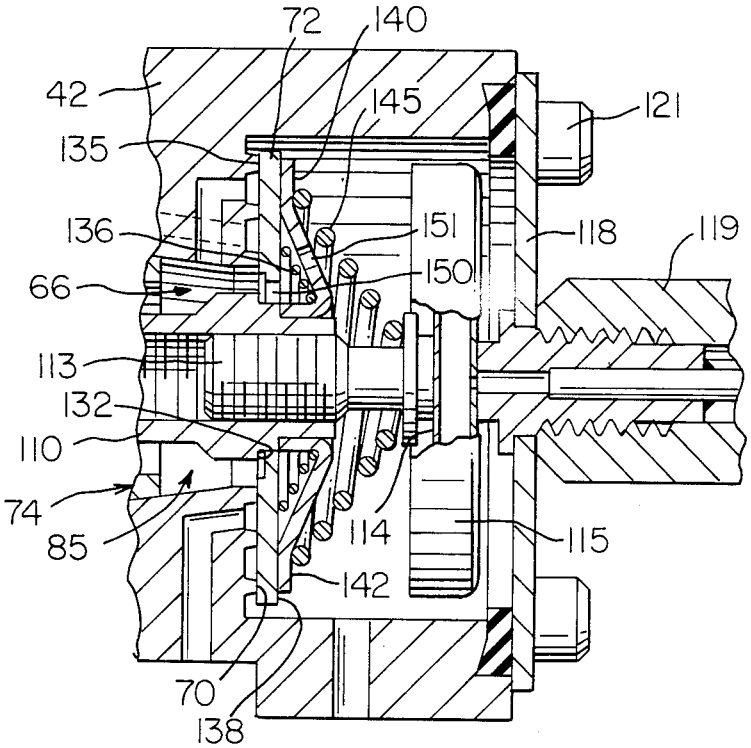
FIG. 21 is a view similar to FIG. 20 and illustrates the thermostatically operated valve member in another operating position thereof when the fuel control device is set in the "broil" position thereof.

However, should the power element 115 continue to move the movable wall 114 to the left in FIG. 20 so as to cause the stud 113, as well as the spring retainer 140, to further move to the left by having the shoulder 132 of the shaft part 110 separate away from the surface 135 of the valve member 72 as the valve member 72 can no longer follow the same to the left in FIG. 21 because the valve member 72 is disposed against the valve seat surface 70, the compression spring 145 is adapted to hold the cylindrical end 190 of the spring retainer 140 in contact with the shoulder 133 of the shaft part 110 in the manner illustrated in FIG. 21 to close the plate-like portion 142 against the surface 138 of the valve member 72 in the manner illustrated in FIG. 21 to close the passage 144 so that now the only amount of fuel that is adapted to flow to the main burner means 33 is the amount permitted to pass from the openings 150 of the closed valve member 72 through the opening 151 of he spring retainer 140. Thus, there is now a further reduction in the size of the flames 183 at the main burner means 33 so as to provide a further control of the temperature in the oven cavity 128 during the broiling operation.

Figure 22:
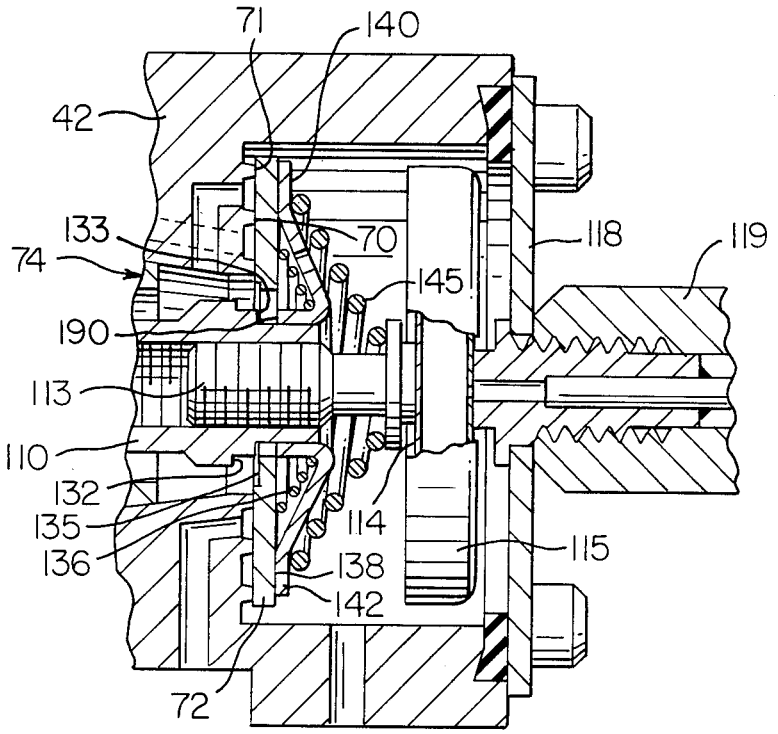
FIG. 22 is a view similar to FIG. 20 and illustrates the thermostatically operated valve member in still another operating condition thereof when the fuel control device is set in the "broil" condition thereof.

Should it be found that the power element 115 further expands so as to cause the wall 114 to further move to the left beyond the position illustrated in FIG. 21, the shaft part 110 can further move to the left in the manner illustrated in FIG. 22 to provide for such an overrun of the power element 115 even though the valve member 72 is disposed against the valve seat surface 70 and the disc-like part 142 of the spring retainer 140 is held against the side 138 of the valve member 72 for the reasons previously set forth.

Therefore, it can be seen that during a broiling operation of the fuel control system 31 of this invention, the fuel control device 30 of this invention continuously maintains the heater flame 41 so that the safety valve 36, once opened, remains open and the power element 115 tends to throttle the flow of fuel to the main burner means 33 not only through modulating the valve member 72 relative to the main valve seat 71, but also once seating the valve member 72 against the main valve seat 71 further provides modulation through the action of the spring retainer 140 closing the space 144 in the manner set forth.

Figure 23:
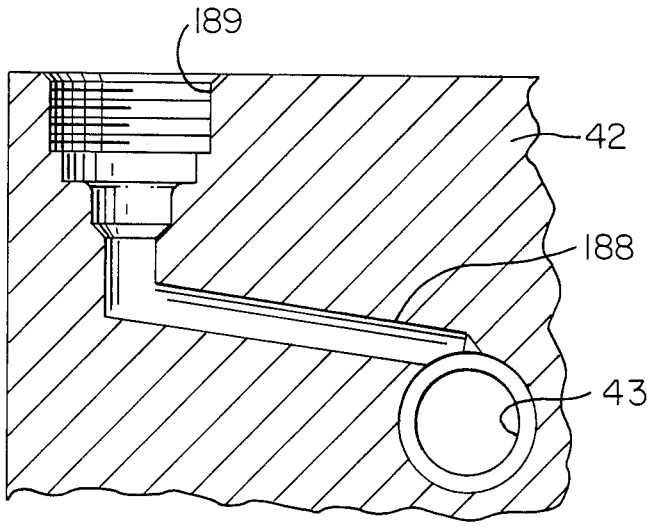
FIG. 23 is a fragmentary cross-sectional view taken on line 23—23 of FIG. 7.

It is to be understood that the fuel control device of this invention can provide other functions as desired. For example, the housing means 42 can be provided with a passage 188 in FIG. 23 that leads to an outlet 189 which can be utilized to supply gas for pilot burners of a top burner arrangement of the cooking apparatus utilizing the fuel control device 30 of this invention.

Therefore, it can be seen that this invention not only provides a new fuel control device and method of making the same, but also this invention provides a new fuel control system utilizing such a fuel control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a fuel control device comprising a housing means having an inlet for being interconnected with a fuel source and an outlet for being interconnected to a main burner means, said housing means having a main valve seat between said inlet and said outlet and a thermostatically operated valve member for opening and closing said main valve seat, said housing means having an annular heater pilot valve seat surrounding said main valve seat and being opened and closed by said thermostatically operated valve member at the same time that said thermostatically operated valve member is opening and closing said main valve seat, the improvement wherein said housing means has an annular auxiliary fuel supply valve seat surrounding said heater pilot valve seat and being adapted to be opened and closed by said thermostatically operated valve member at the same time that said thermostatically operated valve member is opening and closing said main valve seat and said heater pilot valve seat, said, housing means having passage means for interconnecting said inlet to said auxiliary fuel supply valve seat independently of said main valve seat.

2. A fuel control device as set forth in claim 1 wherein said housing means has a substantially flat valve seat surface, said valve seats respectively being defined by recess means that interrupt said flat valve seat surface.

3. A fuel control device as set forth in claim 2 wherein said recess means interrupt said flat valve seat surface in a concentric manner.

4. A fuel control device as set forth in claim 1 wherein said housing means has main on-off valve means disposed in said inlet to open and close said inlet upstream of said main valve seat.

5. A fuel control device as set forth in claim 4 wherein said main on-off valve means comprises a plug valve means.

6. A fuel control device as set forth in claim 4 wherein said housing means has movable selector means operatively interconnected to said main on-off valve means and to said thermostatically operated valve member to respectively set the same in various operating positions thereof.

7. A fuel control device as set forth in claim 1 wherein said housing means has a axially movable selector shaft means for setting said thermostatically operated valve member, said shaft means having a shoulder means, said valve member having an opening passing therethrough and telescopically receiving said shaft means therethrough, and spring means carried by said shaft means and normally urging said valve member against said shoulder means.

8. A fuel control device as set forth in claim 7 wherein said shaft means passes through said main valve seat and cooperates with said main valve seat and said opening of said valve member to provide a by-pass flow of fuel from said inlet to said outlet when said valve member is closed against said valve seat.

9. A fuel control device as set forth in claim 8 wherein said shaft means has an annular plate means carried thereby that cooperates with one side of said valve member to normally provide an annular space therebetween that provides part of said by-pass flow.

10. A fuel control device as set forth in claim 9 wherein said plate means is adapted to close against said one side of said valve member when said valve member is seated against said valve seat so as to close said annular space, said plate means having an opening passing therethrough that cooperates with said main valve seat and said opening of said valve member to provide a by-pass flow of fuel from said inlet to said outlet even when said annular space is closed.

11. In a fuel control system comprising a source of fuel, a main burner means, a pilot burner means, and a housing means having an inlet interconnected to said source and an outlet interconnected to said main burner means, said housing means having a main valve seat between said inlet and said outlet and a thermostatically operated valve member for opening and closing said main valve seat, said housing means having an annular heater pilot valve seat surrounding said main valve seat and being opened and closed by said thermostatically operated valve member at the same time that said thermostatically operated valve member is opening and cloisng said main valve seat, said housing means having means interconnecting said heater pilot valve seat to said pilot burner means, the improvement wherein said housing means has an annular auxiliary fuel supply valve seat surrounding said heater pilot valve seat and being adapted to be opened and closed by said thermostatically operated valve member at the same time that said thermostatically operated valve member is opening and closing said main valve seat and said heater pilot valve seat, said housing means having passage means for interconnecting said inlet to said auxiliary fuel supply valve seat independently of said main valve seat.

12. A fuel control system as set forth in claim 11 wherein said housing means has a substantially flat valve seat surface, said valve seats respectively being defined by recess means that interrupt said flat valve seat surface.

13. A fuel control system as set forth in claim 12 wherein said recess means interrupt said flat valve seat surface in a concentric manner.

14. A fuel control system as set forth in claim 11 wherein said housing means has main on-off valve means disposed in said inlet to open and close said inlet upstream of said main valve seat.

15. A fuel control system as set forth in claim 14 wherein said housing means has movable selector means operatively interconnected to said main on-off valve means and to said thermostatically operated valve member to respectively set the same in various operating positions thereof.

16. A fuel control system as set forth in claim 11 wherein said housing means has an axially movable selector shaft means for setting said thermostatically operated valve member, said shaft means having a shoulder means, said valve member having an opening passing therethrough and telescopically receiving said shaft means therethrough, and spring means carried by said shaft means and normally urging said valve member against said shoulder means.

17. A fuel control system as set forth in claim 16 wherein said shaft means passes through said main valve seat and cooperates with said main valve seat and said opening of said valve member to provide a by-pass flow of fuel from said said inlet to said outlet when said valve member is closed against said valve seat.

18. A fuel control system as set forth in claim 17 wherein said shaft means has an annular plate means carried thereby that cooperates with one side of said valve member to normally provide an annular space therebetween that provides part of said by-pass flow.

19. A fuel control system as set forth in claim 18 wherein said plate means is adapted to close against said one side of said valve member when said valve member is seated against said valve seat so as to close said annular space, said plate means having an opening passing therethrough that cooperates with said main valve seat and said opening of said valve member to provide a by-pass flow of fuel from said inlet to said outlet even when said annular space is closed.

20. In a method of making a fuel control device comprising the steps of providing a housing means having an inlet for being interconnected with a fuel source and an outlet for being interconnected to a main burner means, forming said housing means with a main valve seat between said inlet and said outlet and with a thermostatically operated valve member for opening and closing said main valve seat, and forming said housing means to have an annular heater pilot valve seat surrounding said main valve seat and being opened and closed by said thermostatically operated valve member at the same time that said thermostatically operated valve member is opening and closing said main valve seat, the improvement comprising the steps of forming said housing means to have an annular auxiliary fuel supply valve seat surrounding said heater pilot valve seat and being adapted to be opened and closed by said thermostatically operated valve member at the same time that said thermostatically operated valve member is opening and closing said main valve seat and said heater pilot valve seat, and forming said housing means to have passage means for interconnecting said inlet to said auxiliary fuel supply valve seat independently of said main valve seat.

* * * * *